United States Patent [19]

Johansson

[11] 4,045,840

[45] Sept. 6, 1977

[54] VACUUM CLEANER TOOL FOR CLEANING DEEP PILE CARPETS

[75] Inventor: Erik Karl Gustav Johansson, Sollentuna, Sweden

[73] Assignee: Aktiebolaget Electrolux, Stockholm, Sweden

[21] Appl. No.: 599,594

[22] Filed: July 28, 1975

[30] Foreign Application Priority Data

Aug. 28, 1974 Sweden ..... 7410912

[51] Int. Cl.[2] ..... A47L 9/06

[52] U.S. Cl. ..... 15/397; 15/378; 15/402; 15/422

[58] Field of Search ..... 15/396, 397, 402, 422, 15/378

[56] References Cited

U.S. PATENT DOCUMENTS

| | | | |
|---|---|---|---|
| 3,668,735 | 6/1972 | Dupea | 15/397 |
| 3,771,193 | 11/1973 | Hageal | 15/397 |
| 3,816,872 | 6/1974 | Bayless et al. | 15/397 |
| 3,894,308 | 7/1975 | Carr | 15/397 X |

*Primary Examiner*—Christopher K. Moore
*Attorney, Agent, or Firm*—Alfred E. Miller

[57] ABSTRACT

A vacuum cleaner nozzle tool that is connected to a source of negative pressure and which functions to clean deep pile carpet or shag rugs in an efficient manner and which at the same time raises the pile of the rug or carpet in order to improve the appearance thereof. To achieve this objective the nozzle is provided with slide means of a particular configuration.

7 Claims, 5 Drawing Figures

VACUUM CLEANER TOOL FOR CLEANING DEEP PILE CARPETS

BACKGROUND OF THE INVENTION

It is recognized that the thorough cleaning of deep pile carpets or shag rugs is exceedingly difficult. Since a conventional vacuum cleaning tool cannot penetrate deeply enough in the carpet to remove the dirt and dust particles that are present between and below the fibres of the pile, several attempts have been made to devise and construct a vacuum cleaner tool for cleaning this type of floor covering. One known construction placed a combing device ahead of a conventional vacuum cleaner nozzle in order to improve the dust and dirt pick up capability of the tool. The object of this known construction is to raise the pile of the rug or carpet a sufficient amount to enable the vacuum cleaner nozzle to come close to and clean the bottom area of the carpet. However, this type of tool has proved to be cumbersome, and therefore difficult to handle and, most important, the cleaning result did not prove to be satisfactory.

Another known type of vacuum cleaner tool specifically designed for use on deep pile rugs is described in U.S. Pat. No. 3,733,640 in which a structure is shown having a wire element for contact with the work surface. This structure is arranged to surround an elongated suction opening extending along the entire length of the tool. As this tool is used, the carpet pile is combed by the wire element. However, this tool does not improve the dust pick-up capability over the other known structures, and this generally is due to the form of the suction opening of the tool, and also to the comparatively great distance between the suction opening and the surface to be worked on.

Another type of vacuum cleaner tool is shown and described in U.S. Pat. No. 3,745,603 to Bayless et al, in which a number of suction nozzles are disclosed which project from the tool housing. The nozzles are of such a form that in addition to removing dust and dirt, they comb the carpet pile, thus somewhat improving the removal of the dust and dirt particles from the rug. The cleaning result is better than the other aforementioned suction nozzle, but because of the enlarged area of the intake opening of the suction nozzle the air velocity is quite low near the surface of contact with the carpet, which therefore negatively influences the dust and dirt removing capabilities of the vacuum cleaner tool. Furthermore, the comparatively large width of the nozzles causes part of the carpet pile to be flattened underneath the nozzle instead of being caused to stand up in a substantially vertical plane so that dirt and dust will remain in the carpet and will not be picked up by the tool.

SUMMARY OF THE INVENTION

The present invention relates to a vacuum cleaner tool that is designed for use with deep pile carpets or shag rugs and which has a casing that is operatively connected to a source of negative pressure.

An object of the present invention is to provide a vacuum cleaner tool that not only cleans deep pile carpets and shag rugs efficiently, but also, at the same time, improves the appearance of such rugs and carpeting.

A further object of the present invention is to provide a plurality of suction nozzles communicating with a housing extending in a plane generally perpendicular to the housing. Slide means are provided at the same side of the housing as the nozzles and are constructed and arranged to slide in the direction of movement of said tool on the work surface.

The invention will now be more fully described with reference to the accompanying drawings, as follows.

DESCRIPTION OF THE PREFERRED EMBODIMENTS

Figure 1:
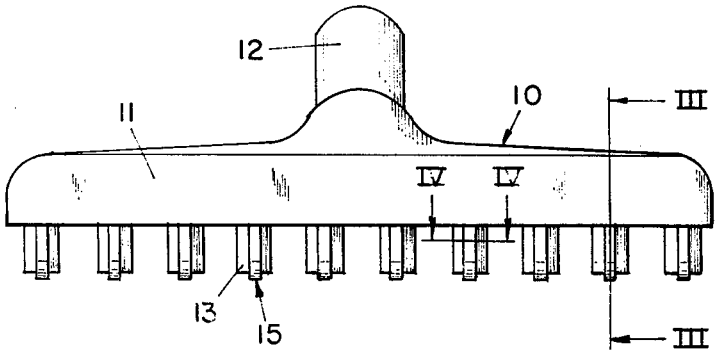
FIG. 1 is a front elevational view of a vacuum cleaner tool for deep pile rugs or the like constructed in accordance with the teachings of the present invention.

The vacuum cleaning tool 10 shown in FIG. 1 comprises an elongated housing 11 which by means of a rotatable tube 12 is connected to a source of negative pressure (not shown).

A plurality of spaced suction nozzles 13 are seen which in the embodiments shown in FIGS. 1 - 4 are substantially rectangular in cross-section.

The nozzles are disposed in a plane which is generally perpendicular to the underside of the housing 11, and dust and dirt laden air flows through the intake openings 14, the housing 11, the tube 12 and a hose (not shown) to a negative pressure generator (not shown), for example, a vacuum cleaner. A number of slide means in the form of runners 15 are secured in spaced relationship at the ends of the nozzles which are remote from the housing 11.

Figure 2:
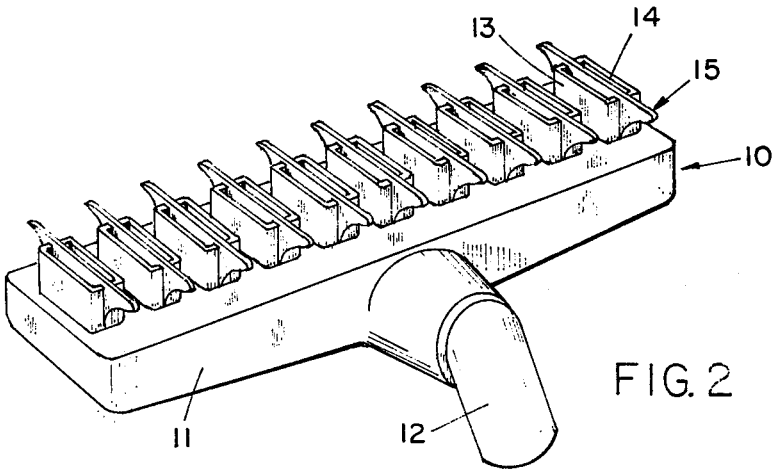
FIG. 2 is a perspective view of the tool, viewing said tool from underneath.
Figure 3:
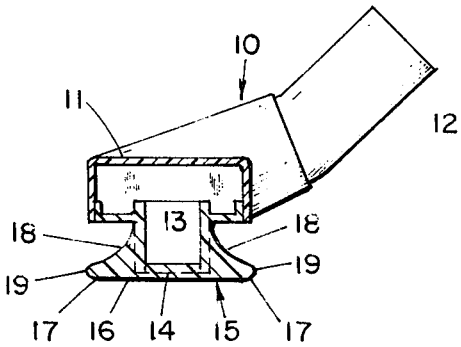
FIG. 3 is a cross-sectional view of the tool taken along the lines III — III of FIG. 1.

As clearly seen in FIGS. 2 and 3, each runner 15 extends substantially perpendicular to the direction of length of the housing 11 and through the center of each nozzle 13, the size of the runner at the connection to the housing, as viewed perpendicularly to the length axis of the housing, generally corresponds to the length of the nozzle 13.

Referring to FIG. 3, it will be seen that each runner 15 has a generally flat undersurface or bottom surface 16 to enable the tool to properly rest on a work surface. Furthermore, two portions 17 are curved upwardly in the direction of the housing 11, which together with the integral upwardly curved portions 18 form both a front and rear lip at each end of the runner. It will be noted that the flat undersurface 16 is at a greater distance from the underside of the housing 11 than the air intake opening 14 of the nozzle 13.

In operation, each runner lip 19 rakes through and below the pile to thereby raise the pile when the vacuum cleaner tool is pushed or pulled on a carpet. The aforesaid construction results in the optimum dust and dirt removal which efficiently and thoroughly cleans the pile and the bottom of the carpet. The configuration of the runners 15 are such that they effect the treatment of the carpet pile, and therefore the nozzles 13 are constructed and arranged for the optimum in cleaning.

Figure 4:
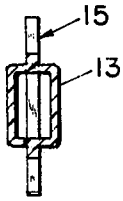
FIG. 4 is another cross-sectional view taken along the lines IV — IV of FIG. 1
Figure 5:
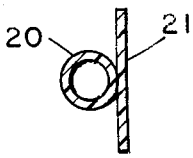
FIG. 5 is a cross-sectional view of an alternate construction of the nozzle and runner members of the present tool.

It should be evident that although the suction nozzle 13, as seen in FIG. 4, is shown as substantially rectangular in cross-section, other configurations can be used. For example, FIG. 5 shows a suction nozzle 20 which is circular in cross-section and a runner 21 which is not disposed in the central plane of the nozzle but is arranged outside of the nozzle 20. In this construction the flow inlet area of the nozzle 20 is unobstructed. Furthermore, it is possible to construct the suction nozzle of a rhombic cross-section and the runner can be placed in an eccentric manner on the nozzle, or even between two nozzles. In all constructions it is only essential that the flat undersurface 16 of the runners 15 are at a greater distance from the housing 11 than the intake openings 14 of the nozzles.

What is claimed is:

1. A vacuum cleaner tool attachable to a source of negative pressure and for use with deep pile carpets or the like comprising an elongated tool housing which is operatively connected to said source of negative pressure, a plurality of suction nozzles each communicating with said tool housing, extending generally in a plane perpendicular to the underside of said housing, a terminating on an air intake opening plurality of surface engaging runners provided on the same side of said housing as said nozzles and each having a bottom surface thereof located at a greater distance below the underside of said housing than the air intake openings of said nozzles, each of said runners bridging a respective suction nozzle and disposed in a plane that is generally perpendicular to the length direction of said tool housing, and each of said runners dividing the respective suction nozzles in substantially equal sections whereby said runners slide in the direction of movement of said tool on the carpet work surface raising the pile and improving dirt removal from the interior of said carpet.

2. A vacuum cleaner tool as claimed in claim 1 wherein each runner is positioned between a pair of suction nozzles.

3. A vacuum cleaner tool as claimed in claim 1, wherein the width of the runner is substantially less than the width of the suction nozzle, as viewed in the length direction of the housing.

4. A vacuum cleaner tool as claimed in claim 1, wherein said bottom surface is flat and each runner has portions at opposite ends of said flat bottom surface which are curved upwardly, an inwardly curved portion joined with each of said upwardly curved portions to attach said runner to a respective one of said nozzles and form a lip on each end of said runner.

5. A vacuum cleaner tool as claimed in claim 4, wherein said flat bottom surface is located at a greater distance from said housing than the inlet opening of said suction nozzle.

6. A vacuum cleaner tool as claimed in claim 1, wherein each of suction nozzles are substantially rectangular in cross-section.

7. A vacuum cleaner tool attachable to a source of negative pressure and for use with deep pile carpets or the like comprising an elongated tool housing which is operatively connected to said source of negative pressure, a plurality of suction nozzles each communicating with said tool housing, extending generally in a plane perpendicular to the underside of said housing, a and terminating in an air intake openings plurality of surface engaging runners provided at the same side of said housing as said nozzles and each having a bottom surface thereof located at a greater distance below the underside of said housing than the air intake inlet openings of said nozzles, each of said runners being disposed in a plane that is generally perpendicular to the length direction of said tool housing, and each of said suction nozzles being circular in cross-section while the respective runners are located outside but abutting the respective suction nozzles whereby said runners slide in the direction of movement of said tool on the carpet work surface raising the pile and improving dirt removal from the interior of said carpet.

* * * * *

UNITED STATES PATENT OFFICE
CERTIFICATE OF CORRECTION

PATENT NO. : 4,045,840

DATED : September 6, 1977

INVENTOR(S) : ERIK KARL GUSTAV JOHANSSON

It is certified that error appears in the above-identified patent and that said Letters Patent are hereby corrected as shown below:

Column 3, line 18, after "housing" insert --and terminating in an air intake opening; --

Lines 18 and 19, cancel "terminating on an air intake opening".

Column 4, line 23, after "housing" insert --and terminating in an air intake opening; --

Lines 23 and 24, cancel "and terminating in an air intake openings".

Signed and Sealed this

***Twentieth* Day of *June 1978***

[SEAL]

*Attest:*

RUTH C. MASON
*Attesting Officer*

DONALD W. BANNER
*Commissioner of Patents and Trademarks*